US005962972A

United States Patent [19]

Engels et al.

[11] Patent Number: 5,962,972

[45] **Date of Patent: *Oct. 5, 1999**

[54] ELECTRIC INCANDESCENT LAMP

[75] Inventors: Gilbert Engels; Gregorius W. A. J. Brabers, both of Turnhout, Belgium

[73] Assignee: U.S. Philips Corporation, New York, N.Y.

[ * ] Notice: This patent is subject to a terminal disclaimer.

[21] Appl. No.: 08/869,264

[22] Filed: Jun. 4, 1997

Related U.S. Application Data

[63] Continuation-in-part of application No. 08/431,881, May 1, 1995, Pat. No. 5,793,161.

[30] Foreign Application Priority Data

Jun. 6, 1996 [EP] European Pat. Off. ..... 96201565

[51] Int. Cl.[6] ..... H01J 17/20; H01J 61/12; H01J 1/16; H01K 1/50

[52] U.S. Cl. ..... 313/578; 313/574; 313/628; 313/344; 313/492

[58] Field of Search ..... 313/492, 631–32, 313/628, 344, 574, 578, 634–35; 445/46, 48–49

[56] References Cited

U.S. PATENT DOCUMENTS

| | | | |
|---|---|---|---|
| 3,170,081 | 2/1965 | Rokosv . | |
| 4,275,329 | 6/1981 | Fridrich et al. | 313/628 |
| 4,783,611 | 11/1988 | Vogels et al. | 313/25 |
| 4,812,710 | 3/1989 | Klam et al. | 313/579 |
| 5,001,397 | 3/1991 | Der Kinderen | 313/628 |
| 5,793,161 | 8/1998 | Peeters et al. | 313/631 |

FOREIGN PATENT DOCUMENTS

0358061A2 3/1990 European Pat. Off. .

*Primary Examiner*—Sandra O'Shea
*Assistant Examiner*—Mack Haynes
*Attorney, Agent, or Firm*—F. Brice Faller

[57] ABSTRACT

The electric incandescent lamp has a lamp vessel (1) in which a filament (3) is disposed substantially concentric with the longitudinal axis (2) of the lamp vessel (1). Current conductors (4) extend from the lamp vessel (1), an internal conductor (10) part of which is substantially concentrically with the axis (2) and has an end portion (11) having unround cross-sections (12). An end portion (6) of the filament (3) is wound onto the unround cross-sections (12) of a respective internal conductor (10) to constitute clamping windings (5). The lamp is of a simple construction to obtain reliably a concentrically mounted filament.

6 Claims, 2 Drawing Sheets

ELECTRIC INCANDESCENT LAMP

This application is a continuation-in-part of U.S. Ser. No. 08/431,881 filed May 1, 1995, now U.S. Pat. No. 5,793,161.

BACKGROUND OF THE INVENTION

The invention relates to an electric incandescent lamp comprising:

- a light-transmitting lamp vessel which is closed in a vacuumtight manner and which has a longitudinal axis;
- a helically coiled tungsten incandescent body inside the lamp vessel, substantially concentric with the axis;
- current conductors each having a straight inner conductor which is substantially concentric with the axis and which has an end portion surrounded by turns integral with the incandescent body, which current conductors issue from the lamp vessel to the exterior.

Such an electric incandescent lamp is known from EP-A-0 358 061.

It is important for some electric incandescent lamps that the incandescent body should be substantially concentric with the longitudinal axis, for example when the lamp vessel has an IR-reflecting filter, or when a centered position of the lamp in an appliance is to achieve a centered position of the incandescent body of the lamp in the applicance.

The incandescent body of the known lamp has a number of turns at both sides and integral with the body of a diameter which is relatively small compared with that of the light-emitting turns of the incandescent body and which merge into end turns of comparatively large diameter. The latter turns are in circumferential contact with the lamp vessel and are held centered thereby.

The inner conductor extends through these end turns, surrounded thereby at a considerable distance, and is threaded into the turns of comparatively small diameter.

The known lamp is of a complicated construction which is difficult to reproduce. The incandescent body with the integral portions thereof on either side comprises turns of three different diameters. These complicate the manufacture of the incandescent body considerably and make its cost high. The incandescent body is supposed to be centered in the lamp vessel by the turns of greatest diameter. These turns, however, are connected to the incandescent body only by means of the flexible wire from which the incandescent body was coiled, so that centering of the former turns does not provide a guarantee for centering of the incandescent body itself.

The inner conductor is merely threaded into the turns of smallest diameter, so that a bad electrical contact is to be feared. Furthermore, manipulation of the incandescent body during threading may eliminate the centering effect.

Other constructions described in the cited document also suffer the disadvantage of complicated shapes such as, for example, an incandescent body having turns which widen continuously from the center to the ends and in which conically coiled inner conductors are accommodated whose free ends are in addition bent away along the centerline of the relevant incandescent body.

SUMMARY OF THE INVENTION

It is an object of the invention to provide an electric incandescent lamp of the kind described in the opening paragraph which is of a simple, reliable construction which can be readily realized.

According to the invention, this object is achieved in that the inner conductor has unround cross-sections in its end portion, and the incandescent body has end portions which are each wound on a respective inner conductor, around the unround cross-sections thereof.

The electric incandescent lamp according to the invention can be easily and quickly manufactured, also as regards the aspects thereof which differ from conventional lamps. An incandescent body obtained in a conventional manner may be used for the manufacture of the lamp, a straight end of the wire from which the incandescent body was coiled still projecting tangentially at both ends. These wire ends are also called the legs of the incandescent body. The inner conductors may then be brought into a centered position relative to the incandescent body, for example by holding the incandescent body and the conductors are held in a jig and/or in positioned chucks. The legs of the incandescent body may then be wound around the inner conductors by coiling them around the inner conductors away from the incandescent body towards their free ends. The region of transition from the incandescent body to the incandescent body leg may be heated in an inert or reducing environment, for example in nitrogen or in nitrogen with, for example, 3 to 5% hydrogen by volume added, or in a rare gas for making the wire locally more ductile and softer. The wire may then be easily plastically deformed by means of a small force. A deformation in an adjoining portion, where it is not desired, is avoided thereby. The incandescent body with the inner conductor adhered thereto may be heated, for example by passing a current through it, so as to eliminate bending stresses caused by coiling in the entire product.

The incandescent body thus obtained and the substantially concentric inner conductors connected thereto may then be processed into a lamp in a conventional manner.

When a wire, for example a leg of an incandescent body, has been coiled around a round core, a round conductor, the wire has a tendency to spring back and slide tangentially along the core. Its turns will then get a larger diameter and the stresses present in the wire owing to coiling will be reduced thereby. The tangential shifting is possible because the wire was wound around the round core with a constant curvature along a helical track. The shift leads to a bad electrical contact.

In the lamp according to the invention, the inner conductor has unround cross-sections at least in its end portion, around which the end portion or leg of the incandescent body is coiled. The turns of the coiled leg do not have a constant curvature, but one which changes within a turn as a result of this, which counteracts a tangential shift of the turn. The turn in fact hooks itself around the inner conductor. The turn retains its initial contact with the inner conductor which was obtained during making of the turn so that the coiled end portion is in substantially circumferential contact with the unround cross-section. The leg as a result has a good electrical and mechanical contact with the inner conductor. The centered position, once obtained, is safeguarded thereby, as is a low contact resistance between the incandescent body and the inner conductor, which benefits the luminous efficacy of the lamp.

The inner conductor may be manufactured, for example, from metal strip and have a rectangular cross-section. It is alternatively possible for the inner conductor to be a round rod which is given unround cross-sections, for example, by means of grinding. A very attractive embodiment, however, is one in which the inner conductor is flattened in a deformation action, for example by means of an impact or by pinching. The transverse dimension of the conductor has become smaller in the hammering or pinching device compared with its initial state and with places where no deformation has taken place, and has become greater transversely to the hammering or pinching direction. It is favorable to give the inner conductor unround cross-sections by means of a deformation because this can be done quickly, without creating waste material, and because the shape of the cross-sections does change, but the dimension thereof does not or substantially not change, so that the conductance of the conductor remains substantially the same. This is not the case if material is removed, for example by grinding.

Since the legs of the incandescent body are coiled directly on the inner conductors, these legs are in contact with the inner conductors over at least the major portion of their coiled length, and the inner conductors are in contact with the legs on all sides. If a previously coiled leg were applied around an unround conductor, round turns would become oval and the turns would each be in contact with the conductor over a small portion only. In addition, a concentric position of the incandescent body and the conductors would then not be achieved owing to the manipulation. Previously manufactured turns subsequently passed over the inner conductor would have to be wider internally than the external dimension of the inner conductor. It would be impossible as a result for the inner conductor to be in contact with turns on all sides. This is true to a greater extent for an inner conductor with cross-sections of changing shape along its longitudinal direction. Dimensional tolerances of the coiling mandrel and of the inner conductor also influence the fit of previously made coils.

The end portions of the incandescent body grip around the end portions of the relevant inner conductor with clamping fit. A favorable embodiment is one in which the inner conductor has unround cross-sections in the end portion locally only. The unround cross-sections are then separate from the end of the inner conductor lying adjacent the incandescent body. This embodiment has the advantage that there is not only a coupling between the incandescent body and the inner conductor based on a clamping force, but also a coupling based on matching shapes owing to the cross-sections of changing shape along the longitudinal direction of the conductor. It requires a comparatively strong force then for pulling the turns axially off the inner conductor.

The inner conductor may have several regions with unround cross-sections in its end portion. A large force is necessary also in that case for pulling the turns axially off the inner conductor.

Since the inner conductor is a separate body added to the previously formed incandescent body, the material of the conductor may be chosen as desired. It is often favorable to use tungsten because of the thermal and mechanical resistance of this metal.

The lamp vessel may be made, for example, of glass, for example glass with an $SiO_2$ content of at least 95% by weight, such as quartz glass, or alternatively of hard glass. The lamp vessel may have various shapes, for example cylindrical, spherical, or elliptical. The lamp vessel may be fitted with an optical filter, for example an IR-reflecting filter, for example a dichroic filter built up from a plurality of layers of high and low refractive index, possibly with intermediate layers of intermediate refractive index. A material of low refractive index which may be used for this is, for example, $SiO_2$, a material of high refractive index, for example, $Ta_2O_5$, $Nb_2O_5$, $Si_3N_4$, and a material of intermediate refractive index, for example, silicon oxynitride.

The lamp vessel may be evacuated or filled with a gas, for example with an inert gas such as rare gas and/or nitrogen to which a halogen or halogen compound, such as HBr or $CH_2Br_2$ is added for obtaining a regenerative cycle.

BRIEF DESCRIPTION OF THE DRAWINGS

An embodiment of the electric incandescent lamp according to the invention is shown in the drawing. In the drawing.

DETAILED DESCRIPTION OF THE DRAWINGS

Figure 1:
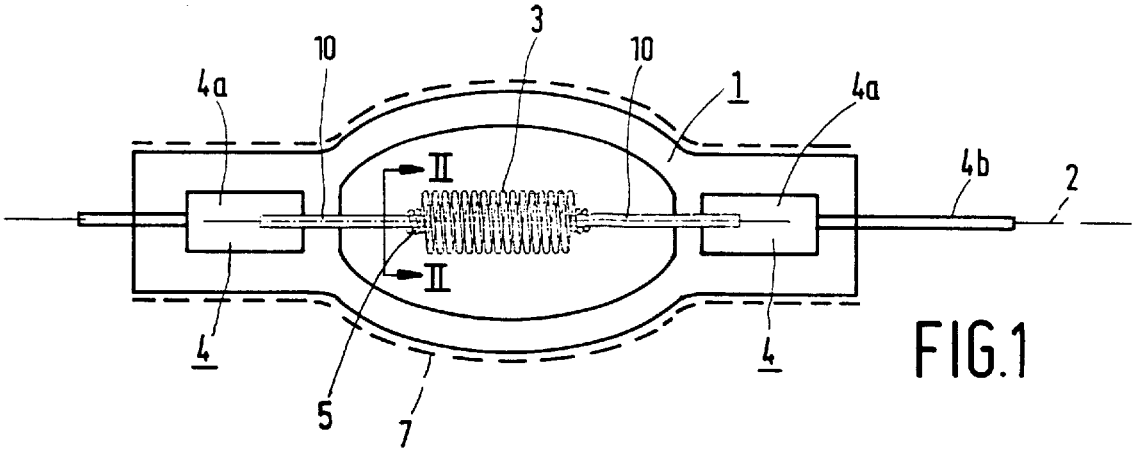
FIG. 1 shows a lamp in side elevation.
Figure 2:
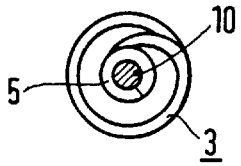
FIG. 2 shows the incandescent body viewed along II in FIG. 1.

In FIG. 1, the electric incandescent lamp has a light-transmitting lamp vessel 1, made of quartz glass in the Figure, which is closed in a vacuumtight manner and which has a longitudinal axis 2. A helically coiled tungsten incandescent body 3 is arranged inside the lamp vessel 1, substantially concentrically with the axis 2. Current conductors 4 each comprising a straight inner conductor 10 issue from the lamp vessel 1 to the exterior, inner conductors 10 each being substantially concentric with the axis 2 and having an end portion 11 which is surrounded by coiled portions 5 integral with the incandescent body 3. Molybdenum foils 4*a* are welded to the inner conductors 10 and are connected each to a molybdenum wire 4*b* so as jointly to form the current conductors 4. The lamp vessel 1 has an ellipsoidal outer surface on which an IR-reflecting filter 7 is deposited which reflects IR-radiation generated by the incandescent body 3, throwing back this radiation substantially onto the incandescent body owing to the centered position of the incandescent body 3 on the longitudinal axis 2, i.e. the major axis of the ellipsoid. The lamp vessel 1 is filled with an inert gas to which hydrogen bromide has been added.

Figure 4:
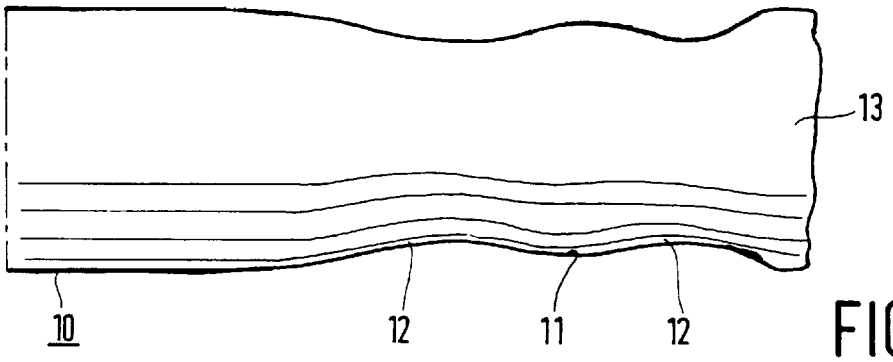
FIGS. 4 and 5 are side elevations of the inner conductor mutually rotated through 90°.
Figure 5:
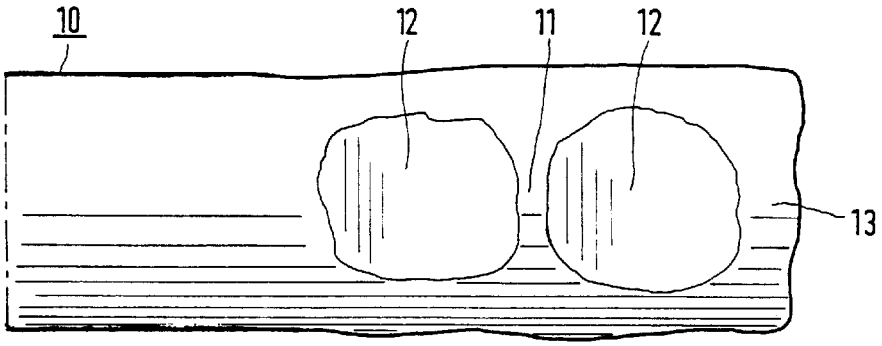

The inner conductor 10, made of tungsten in the Figure, has unround cross-sections 12 in its end portion 11, see also FIGS. 4 and 5, and the incandescent body 3 has end portions 6 which are each coiled on a respective inner conductor 10, around the unround cross-sections 12 thereof.

The unround cross-sections 12 in the end portion 11 were obtained through deformation of this end portion 11. In the embodiment shown, see also FIGS. 4 and 5, this was done by means of a hammer and a matching anvil. The initially substantially round conductor 10 was locally made thinner thereby in the hammering device, see FIG. 4, and wider transverse to the hammering direction, see FIG. 5. The deformation has given the inner conductor an axial zone in which the cross-sections are not only unround, but also change their shapes.

Figure 3:
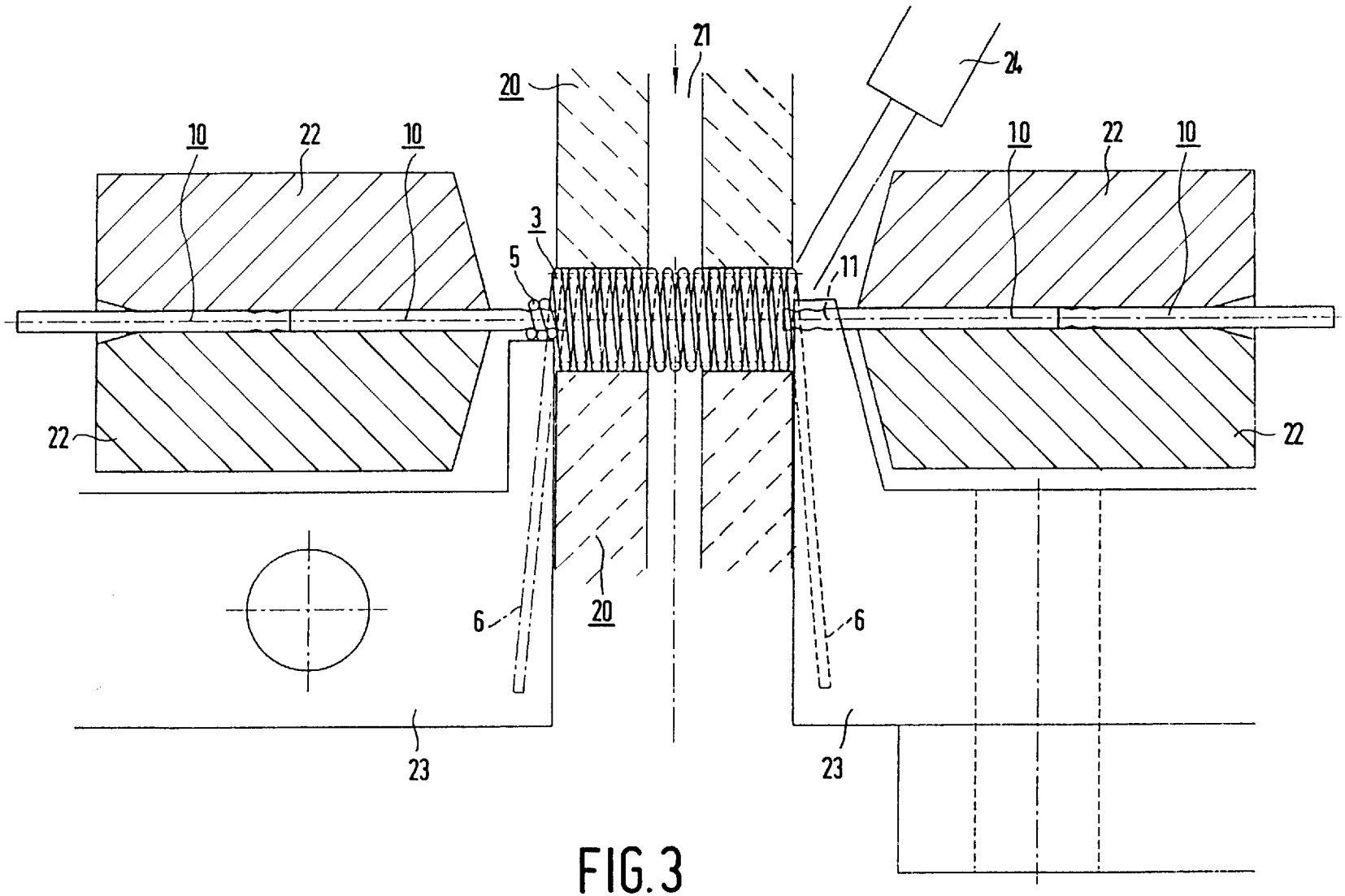
FIG. 3 shows a step in the assembly process of the incandescent body.

The unround cross-sections 12 are separate from the end 13 of the inner conductor 10 lying adjacent the incandescent body 3, see also FIG. 3.

The end portion 11 of the inner conductor 10 has several, here two regions of unround cross-section 12, see FIGS. 4 and 5, which were each created by a local hammer impact.

In FIG. 3, the incandescent body 3 is held in jigs 20 which have a channel 21 for supplying an inert gas. Current conductors 10 are centered relative to the incandescent body 3 and held by chucks 22. A burner 24 can heat a portion of the outermost turn of the incandescent body 3 so as to make it soft and pliable, so that it can be readily bent towards the inner conductor without deformation of the remainder of the turn and of the other turns. A winding head 23 on the right in the Figure is capable of coiling the still straight end portion 6 of the incandescent body 3 extending tangentially away from the incandescent body 3 around the end portion 11 of the inner current conductor 10 in situ so as to form a coiled end portion 5 of the kind already finished on the left in the Figure.

We claim:

1. An electric lamp comprising a light transmitting lamp vessel which is closed in a vacuum tight manner, a pair of current conductors in the lamp vessel, each current conductor having an end portion with an unround cross-section, and tungsten coil means comprising a pair of coiled portions which are wound in situ around respective said end portions of said current conductors so that said coiled portions are in substantially circumferential contact with said unround cross-sections.

2. An electric lamp as in claim 1 wherein each end portion has a plurality of unround cross-sections, said coil portions being in substantially circumferential contact with each of said unround cross-sections.

3. An electric lamp as in claim 1 wherein the unround cross-sections are formed by deformation of the end portions.

4. An electric lamp as in claim 3 wherein said unround cross-sections are formed prior to winding said coiled portions around said end portions of said current conductors.

5. An electric lamp as in claim 1 further comprising light producing means inside said lamp vessel, between said end portions of said current conductors.

6. An electric lamp as in claim 1 wherein said tungsten coil means comprises a helically coiled tungsten incandescent body having coiled end portions integral with said incandescent body, said incandescent body serving as said light producing means, said coiled end portions being said coiled portions which are wound around said end portions of said current conductors.

* * * * *